US009310711B2

(12) United States Patent
Ohta et al.

(10) Patent No.: US 9,310,711 B2
(45) Date of Patent: Apr. 12, 2016

(54) IMAGE FORMING APPARATUS WITH MULTIPLE MEDIUM-DEPENDENT MEASUREMENTS FOR RELATIVE EMISSION TIMINGS

(71) Applicant: CANON KABUSHIKI KAISHA, Tokyo (JP)

(72) Inventors: Yuya Ohta, Toride (JP); Kuniyasu Kimura, Toride (JP); Takuya Hayakawa, Koshigaya (JP); Kiyoharu Kakomura, Kashiwa (JP); Seita Inoue, Kashiwa (JP); Naoka Omura, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/670,694

(22) Filed: Mar. 27, 2015

(65) Prior Publication Data

US 2015/0286158 A1 Oct. 8, 2015

(30) Foreign Application Priority Data

Apr. 3, 2014 (JP) ..... 2014-077254

(51) Int. Cl.

| | |
|---|---|
| ***B41J 2/435*** | (2006.01) |
| ***B41J 2/385*** | (2006.01) |
| ***G03G 15/043*** | (2006.01) |
| *G03G 15/04* | (2006.01) |

(52) U.S. Cl.
CPC ..... *G03G 15/043* (2013.01); *G03G 15/04072* (2013.01); *G03G 2215/00599* (2013.01)

(58) Field of Classification Search
CPC ..... G03G 15/043; G03G 2215/00599; G03G 15/04072
USPC ..... 347/224, 118
See application file for complete search history.

(56) References Cited

FOREIGN PATENT DOCUMENTS

| | | | |
|---|---|---|---|
| JP | 2008-089695 | | 4/2008 |
| JP | 2008089695 | * | 4/2008 |
| JP | 2009-297917 | | 12/2009 |

* cited by examiner

*Primary Examiner* — Julian Huffman
*Assistant Examiner* — Carlos A Martinez
(74) *Attorney, Agent, or Firm* — Fitzpatrick, Cella, Harper & Scinto

(57) ABSTRACT

An image forming apparatus determines a time length of a non-image-forming period in which image formation is not performed, the non-image-forming period being from when image formation on one recording sheet ends to when image formation on the next recording sheet starts, and based on the determined time length, decides the number of times of executing measurement (BD interval measurement) of a generation timing difference between detection signals corresponding to light beams emitted from two light emitting elements. The image forming apparatus executes the decided number of times of BD interval measurement and calculates an average value of the resultant measurement values.

6 Claims, 11 Drawing Sheets

IMAGE FORMING APPARATUS WITH MULTIPLE MEDIUM-DEPENDENT MEASUREMENTS FOR RELATIVE EMISSION TIMINGS

BACKGROUND OF THE INVENTION

1. Field of the Invention

The present invention relates to an electrophotographic image forming apparatus.

2. Description of the Related Art

Conventionally, there are known to be image forming apparatuses that form electrostatic latent images on a photosensitive member by using a rotating polygonal mirror to deflect a light beam emitted from a light source and scanning the photosensitive member with the deflected light beam. This kind of image forming apparatus includes an optical sensor (beam detection (BD) sensor) for detecting the light beam deflected by the rotating polygonal mirror, and the optical sensor generates a synchronization signal upon detecting the light beam. By causing the light beam to be emitted from the light source at a timing determined using the synchronization signal generated by the optical sensor as a reference, the image forming apparatus aligns the writing start positions for the electrostatic latent image (image) in the direction (main scanning direction) in which the light beam scans the photosensitive member.

Also, there are known to be multi-beam image forming apparatuses that include multiple light emitting elements as a light source for emitting multiple light beams that each scan different lines on the photosensitive member in parallel in order to realize a higher image formation speed and higher resolution images. With this kind of multi-beam image forming apparatus, a higher image formation speed is realized by scanning multiple lines in parallel using multiple light beams, and higher resolution images are realized by adjusting the interval between the lines in the sub-scanning direction.

Japanese Patent Laid-Open No. 2008-89695 discloses an image forming apparatus that includes multiple light emitting elements as a light source and is capable of adjusting the resolution in the sub-scanning direction by performing rotational adjustment of the light source in the plane in which the light emitting elements are arranged. This kind of resolution adjustment is performed in the step of assembling the image forming apparatus. Japanese Patent Laid-Open No. 2008-89695 discloses a technique for suppressing misalignment in the writing start positions in the main scanning direction for the electrostatic latent image that occur due to light source attachment errors in the assembly step. Specifically, the image forming apparatus uses a BD sensor to detect light beams emitted from a first light emitting element and a second light emitting element and generates multiple BD signals. Furthermore, the image forming apparatus sets a light beam emission timing for the second light emitting element relative to the light beam emission timing for the first light emitting element based on the generation timing difference between the generated BD signals. This compensates for light source attachment errors in the assembly step and suppresses misalignment in the writing start positions for the electrostatic latent image between the light emitting elements.

Also, there is known to be a technique of shorting, in an image forming apparatus, the period from when image formation processing is started until when a recording sheet on which an image has been formed is discharged to the greatest extent possible, thereby starting a polygon motor at an earlier time in order to obtain print output somewhat earlier. For example, Japanese Patent Laid-Open No. 2009-297917 discloses an image forming apparatus which, when a document is set, starts a polygon motor without turning on a light emitting element (laser diode) and controls the rotation speed of the polygon motor so as to be constant. Upon receiving input of a job in a state where the polygon motor is rotating at a stable rotation speed, this image forming apparatus turns on the light emitting element in order to cause a BD sensor to output a BD signal. Furthermore, the image forming apparatus starts an image forming operation at a time when the cycle of the BD signals output from the BD sensor reaches a cycle proportional to a target number of rotations of the polygon motor. Thus, the image forming apparatus disclosed in Japanese Patent Laid-Open No. 2009-297917 generates BD signals in non-image-forming periods, in which image formation is not performed.

However, the following problems are present in the method of, in an image forming apparatus including multiple light emitting elements as a light source, measuring the generation timing difference between BD signals generated by a BD sensor as described above.

If it is possible to execute multiple times of measuring the generation timing difference (time interval) between two BD signals corresponding to light beams emitted from first and second light emitting elements in a non-image-forming period, the measurement accuracy can be improved by averaging the obtained measurement values. In general, the length of a non-image-forming period changes depending on the size of the sheet used in image formation, adjustment operations performed in the non-image-forming period, and the like. However, the number of times of measuring the time interval between BD signals performed in a non-image-forming period has conventionally been set according to the shortest non-image-forming period, and therefore there have been cases where a number of measurement values sufficient for achieving the required measurement accuracy cannot be obtained. In particular, as shown in FIG. 9, when a polygon mirror starts to rotate, the temperature in the image forming apparatus (optical scanning apparatus) changes dramatically. In this case, if the time needed to obtain the number of measurement values necessary for averaging increases in length, the average value of the BD interval measurement results will have a greater error. For this reason, in order to improve the measurement accuracy while following this kind of temperature change, it is desirable to execute a greater number of times of measurement in a non-image-forming period.

SUMMARY OF THE INVENTION

The present invention has been made in view of the foregoing problems. The present invention provides a technique for, in an image forming apparatus including multiple light emitting elements, determining the length of a non-image-forming period in which a generation timing difference between detection signals corresponding to light beams emitted from two light emitting elements is measured, and suppressing a decrease in the accuracy of the measurement result.

According to one aspect of the present invention, there is provided an image forming apparatus including a light source that includes a plurality of light emitting elements that each emit a light beam, and a deflection unit configured to deflect a plurality of light beams emitted from the plurality of light emitting elements such that the plurality of light beams scan a photosensitive member, the image forming apparatus being configured to use toner to develop an electrostatic latent image formed on the photosensitive member by scanning the photosensitive member with the plurality of light beams and to transfer a developed toner image onto a recording medium, the image forming apparatus comprising: an optical sensor provided on a scanning path of a light beam deflected by the deflection unit, configured to, in response to the deflected light beam being incident on the optical sensor, output a detection signal indicating that the light beam has been detected; an determination unit configured to determine a length of a non-image-forming period in which an electrostatic latent image for forming a toner image to be transferred onto a recording medium is not formed, the non-image-forming period being from when formation of an electrostatic latent image for forming a toner image to be transferred onto one recording medium ends to when formation of an electrostatic latent image for forming a toner image to be transferred onto a subsequent recording medium starts; a measurement unit configured to, in the non-image-forming period, control the light source such that light beams from first and second light emitting elements among the plurality of light emitting elements are incident on the optical sensor in sequence, and measure a time interval between two detection signals output in sequence from the optical sensor, wherein the measurement unit executes measurement using the optical sensor a number of times which corresponds to the length of the non-image-forming period determined by the determination unit, and calculates an average value of resultant measurement values; and a control unit configured to, based on the average value obtained by the measurement unit, control relative emission timings according to which the plurality of light emitting elements emit light beams based on image data, when image formation on a recording medium is to be performed.

According to the present invention, in an image forming apparatus including multiple light emitting elements, it is possible to determine the length of a non-image-forming period in which a generation timing difference between detection signals corresponding to light beams emitted from two light emitting elements is measured, and to suppress a decrease in the accuracy of the measurement result.

Further features of the present invention will become apparent from the following description of exemplary embodiments with reference to the attached drawings.

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

The following describes an exemplary case in which the present invention has been applied to an image forming apparatus that forms multi-color (full-color) images using toner (developing material) of multiple colors and to an optical scanning apparatus included in the image forming apparatus, as embodiments of the present invention. Note that the present invention can also be applied to an image forming apparatus that forms mono-color images using only a single color of toner (e.g., black) and to an optical scanning apparatus included in the image forming apparatus.

Hardware Configuration of Color Multi-Function Printer

Figure 1:
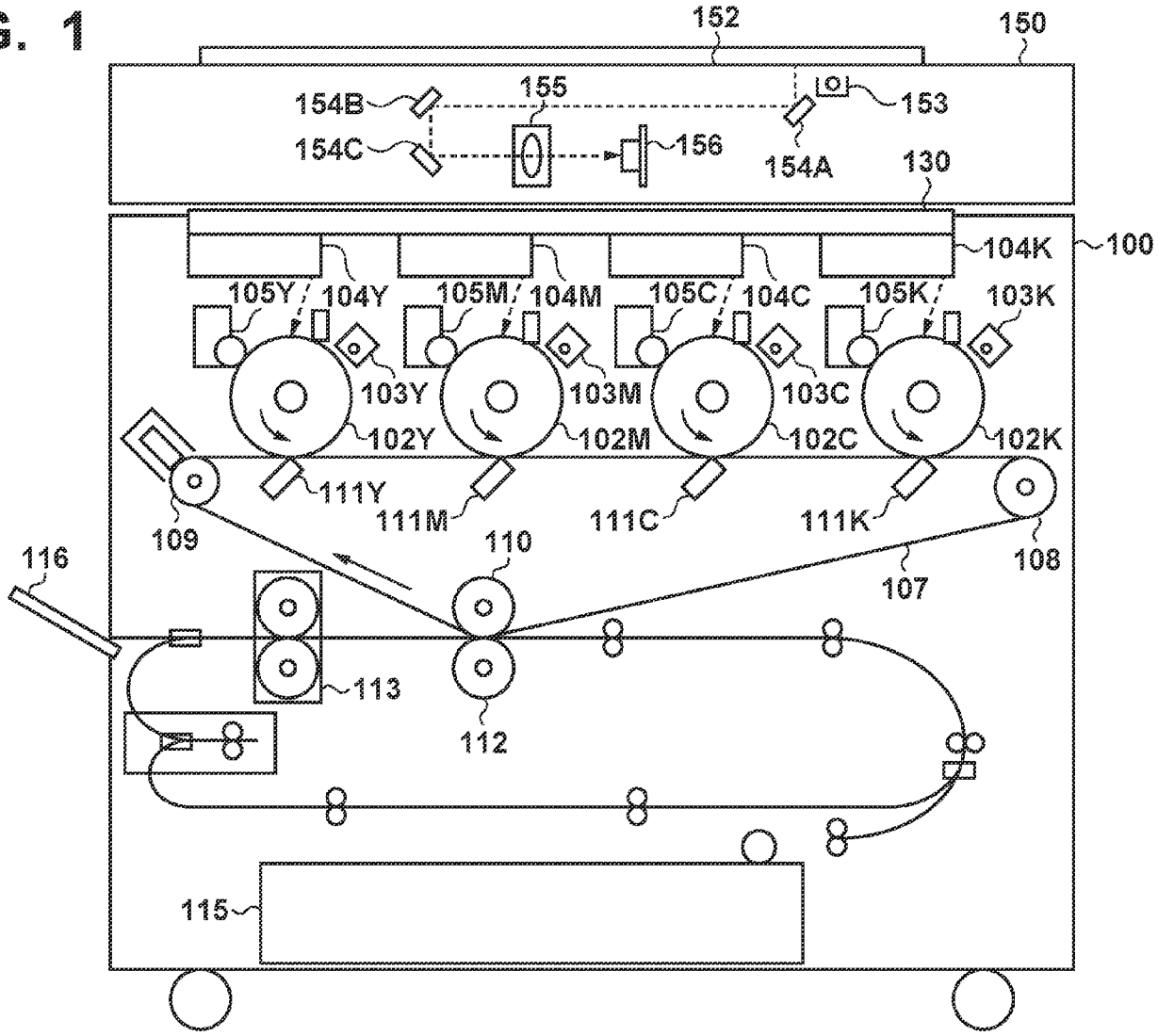
FIG. 1 is a cross-sectional diagram showing an example of an overall configuration of an image forming apparatus.

First, a configuration of a color multi-function printer according to embodiments of the present invention will be described with reference to FIG. 1. As shown in FIG. 1, a color multi-function printer is constituted by an image reading apparatus 150 and an image forming apparatus 100.

The image reading apparatus 150 forms an image of a document 152 on a color sensor 156 via an illumination lamp 153, a group of mirrors 154A, 154B, and 154C, and a lens 155. According to this, the image reading apparatus 150 reads an image of a document for each color-separated light of the colors blue (B), green (G), and red (R) for example, converts the images into electric image signals, and transmits the converted image signals to a central image processor 130 in the image forming apparatus 100.

Figure 4:
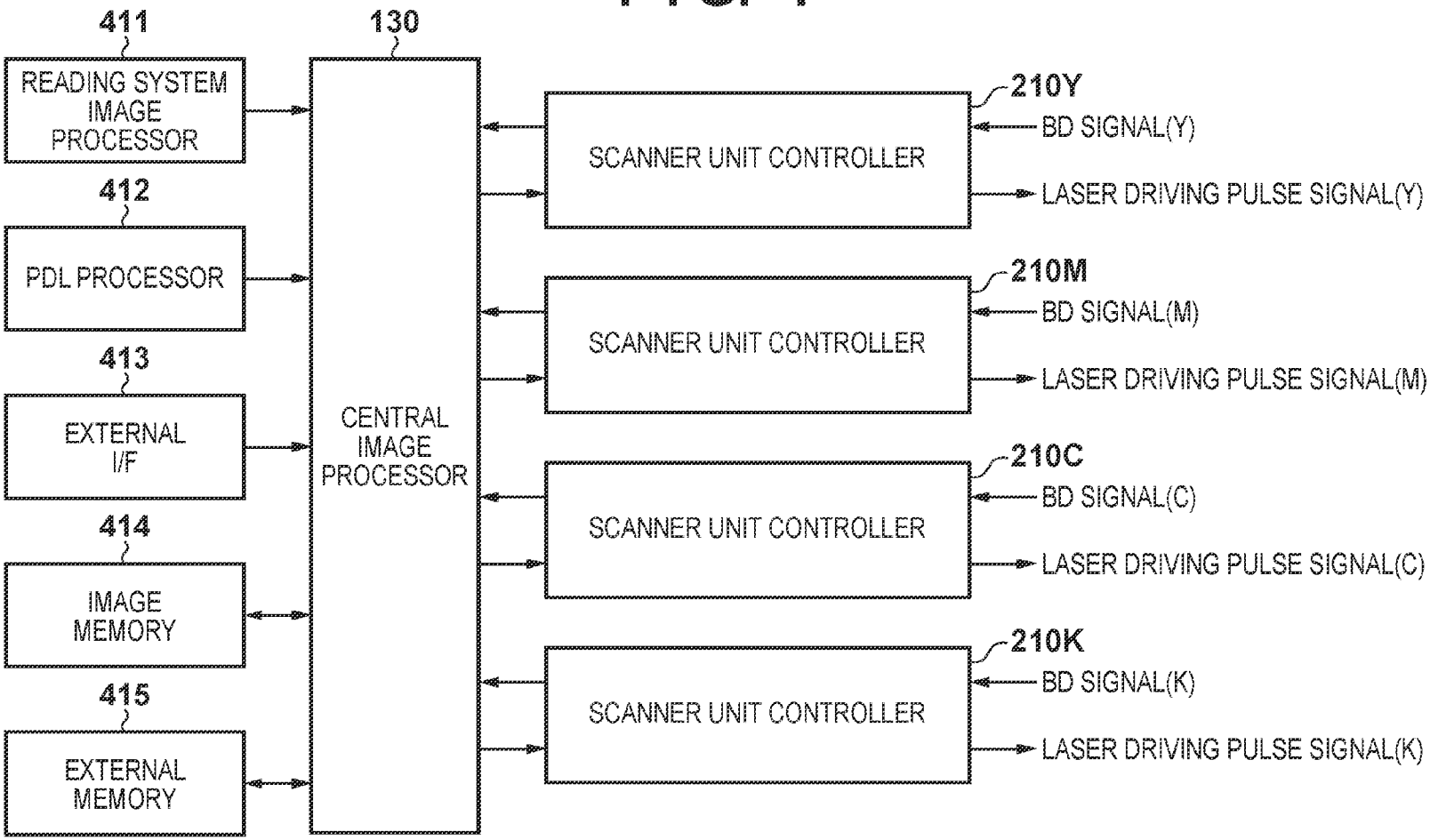
FIG. 4 is a block diagram showing an example of a control configuration of an image forming apparatus.

The central image processor 130 executes color conversion processing based on the intensity levels of the color components R, G, and B that are included in the image signals obtained by the image reading apparatus 150. According to this, image data composed of color components yellow (Y), magenta (M), cyan (C), and black (K) is obtained. The central image processor 130 can receive external input data not only from the image reading apparatus 150, but also from an external device on a network such as a phone line or a LAN via an external interface (I/F) 413 (FIG. 4) that is included in the color multi-function printer. In this case, if the data received from the external apparatus is in PDL (Page Description Language) format, the central image processor 130 can obtain image data by rendering received external input data into image information using a PDL processor 412 (FIG. 4).

The image forming apparatus 100 includes four image forming units that form images (toner images) using Y, M, C, and K toner respectively. The image forming units corresponding to the respective colors include photosensitive drums (photosensitive members) 102Y, 102M, 102C, and 102K respectively. Charging units 103Y, 103M, 103C, and 103K, optical scanning units (optical scanning apparatuses) 104Y, 104M, 104C, and 104K, and developing units 105Y, 105M, 105C, and 105K are arranged in the periphery of the photosensitive drums 102Y, 102M, 102C, and 102K respectively. Note that drum cleaning units (not shown) are further arranged in the periphery of the photosensitive drums 102Y, 102M, 102C, and 102K respectively.

An intermediate transfer belt (intermediate transfer member) 107 in the shape of an endless belt is arranged below the photosensitive drums 102Y, 102M, 102C, and 102K. The intermediate transfer belt 107 is wound around a driving roller 108 and driven rollers 109 and 110. When image formation is in progress, the peripheral surface of the intermediate transfer belt 107 moves in the direction of the arrow shown in FIG. 1 in accordance with the rotation of the driving roller 108. Primary transfer bias blades 111Y, 111M, 111C, and 111K are arranged at positions opposing the photosensitive drums 102Y, 102M, 102C, and 102K via the intermediate transfer belt 107. The image forming apparatus 100 further includes a secondary bias roller 112 for transferring the toner image formed on the intermediate transfer belt 107 onto a recording sheet (recording medium), and a fixing unit 113 for fixing, to the recording sheet, the toner image that has been transferred onto the recording sheet.

Image forming processes from a charging process to a developing process in the image forming apparatus 100 having the above-described configuration will be described next. Note that the image forming processes executed by the respective image forming units that correspond to the respective colors are similar to each other. For this reason, a description will be given below using the image forming processes executed by the image forming unit corresponding to Y as an example, and the image forming processes in the image forming units corresponding to M, C, and K will not be described.

First, the charging unit 103Y in the image forming unit corresponding to Y charges the surface of the photosensitive drum 102Y that is being driven so as to rotate. The optical scanning unit 104Y emits multiple laser beams (light beams) and scans the charged surface of the photosensitive drum 102Y with the laser beams, thereby exposing the surface of the photosensitive drum 102Y. According to this, an electrostatic latent image is formed on the rotating photosensitive drum 102Y (on the photosensitive member). After being formed on the photosensitive drum 102Y, the electrostatic latent image is developed by the developing unit 105Y using Y toner. As a result, a Y toner image is formed on the photosensitive drum 102Y. Also, in the image forming units corresponding to M, C, and K, M, C, and K toner images are formed on the photosensitive drums 102M, 102C, and 102K respectively with processes similar to that of the image forming unit corresponding to Y.

The image forming processes from a transfer process onward will be described below. In the transfer process, first, the primary transfer bias blades 111Y, 111M, 111C, and 111K apply a transfer bias to the intermediate transfer belt 107. According to this, toner images of four colors (Y, M, C, and K) that have been formed on the photosensitive drums 102Y, 102M, 102C, and 102K are transferred in an overlaid manner onto the intermediate transfer belt 107.

After being formed on the intermediate transfer belt 107 in an overlaid manner, the toner image composed of four colors of toner is conveyed to a secondary nip portion between the secondary transfer bias roller 112 and the intermediate transfer belt 107 in accordance with the movement of the peripheral surface of the intermediate transfer belt 107. A recording sheet is conveyed from a paper feeding cassette 115 to the secondary transfer nip portion in synchronization with the time at which the toner image formed on the intermediate transfer belt 107 is conveyed to the secondary transfer nip portion. In the secondary transfer nip portion, the toner image formed on the intermediate transfer belt 107 is transferred onto the recording sheet by a transfer bias applied by the secondary transfer bias roller 112 (secondary transfer).

After being formed on the recording sheet, the toner image undergoes heating in the fixing unit 113 and is thereby fixed to the recording sheet. After a multi-color (full color) image is formed in this way on the recording sheet, the recording sheet is discharged to a discharge unit 725.

Note that after the transfer of the toner image onto the intermediate transfer belt 107 ends, toner remaining on the photosensitive drums 102Y, 102M, 102C, and 102K is removed by the above-mentioned corresponding drum cleaning units. When a series of image forming processes ends in this way, image forming processes for the next recording sheet are subsequently started.

Hardware Configuration of Optical Scanning Unit

The configuration of the optical scanning units 104Y, 104M, 104C, and 104K will be described next with reference to FIG. 2 and FIGS. 3A to 3C. Note that since the configurations of the optical scanning units 104Y, 104M, 104C, and 104K (image forming units corresponding to Y, M, C, and K) are the same, there are cases below where reference numerals are used without the suffixes Y, M, C, and K. For example, "photosensitive drum 102" represents the photosensitive drums 102Y, 102M, 102C, and 102K, and "optical scanning unit 104" represents the optical scanning units 104Y, 104M, 104C, and 104K.

Figure 2:
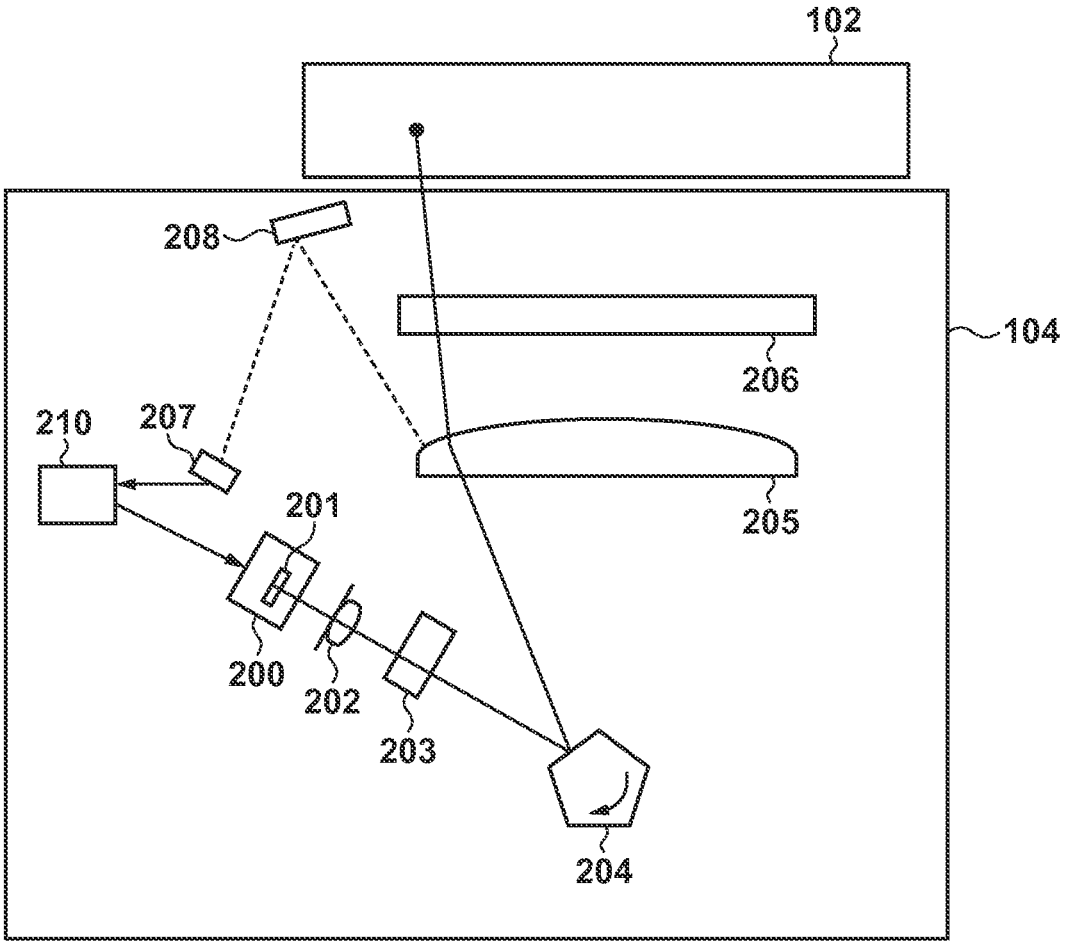
FIG. 2 is a diagram showing an example of an overall configuration of an optical scanning unit.

FIG. 2 is a diagram showing the configuration of the optical scanning unit 104. The optical scanning unit 104 includes a laser driver 200, a laser light source 201, and various optical members 202 to 206 (a collimator lens 202, a cylindrical lens 203, a polygon mirror (rotating polygonal mirror) 204, and fθ lenses 205 and 206). The laser driver 200 controls driving of the laser light source 201 using a driving current supplied to the laser light source 201. The laser light source (referred to hereinafter as simply "light source") 201 generates and outputs (emits) a laser beam (light beam) with a light power that corresponds to the driving current. The collimator lens 202 shapes the laser beam emitted from the light source 201 into collimated light. After the laser beam has passed through the collimator lens 202, the cylindrical lens 203 condenses the laser beam in the sub-scanning direction (direction corresponding to the rotation direction of the photosensitive drum 102).

After passing through the cylindrical lens 203, the laser beam is incident on one of the reflecting surfaces of the polygon mirror 204. The polygon mirror 204 rotates in the direction of the arrow shown in FIG. 2 and causes the laser beam to be reflected by the reflection surfaces such that the incident laser beam is deflected at continuous angles. The laser beam deflected by the polygon mirror 204 is sequentially incident on the fθ lenses 205 and 206. Due to passing through the fθ lenses (scanning lenses) 205 and 206, the laser beam becomes a scanning beam that scans the surface of the photosensitive drum 102 at a constant speed.

On the scanning path of the laser beam that has passed through the fθ lens 205, the optical scanning unit 104 includes a reflection mirror (synchronization detection mirror) 208 at a position on the laser beam scan start side. A laser beam that has passed through the end of the fθ lens is incident on the reflection mirror 208. The optical scanning unit 104 further includes a beam detection (BD) sensor 207 as an optical sensor for detecting a laser beam, in the reflection direction of the laser beam from the reflection mirror 208. Thus, the BD sensor 207 is arranged on the scanning path of the laser beam deflected by the polygon mirror 204. That is to say, the BD sensor 207 is provided on the scanning path in the case where the multiple laser beam emitted from the light source 201 scan the surface of the photosensitive drum 102.

When a laser beam deflected by the polygon mirror 204 is incident on the BD sensor 207, the BD sensor 207 outputs, as a synchronization signal (horizontal synchronization signal), a detection signal (BD signal) indicating that a laser beam has been detected by the BD sensor 207. The BD signal output from the BD sensor 207 is input to the scanner unit controller 210. As will be described later, the scanner unit controller 210 uses the BD signals output from the BD sensor 207 as a reference to control the turning-on timing of the light emitting elements ($LD_1$ to $LD_N$) based on the image data.

Next, the configuration of the light source 201 and the scanning positions of laser beams emitted from the light source 201 on the photosensitive drum 102 and the BD sensor 207 will be described with reference to FIGS. 3A to 3C.

Figure 3A:
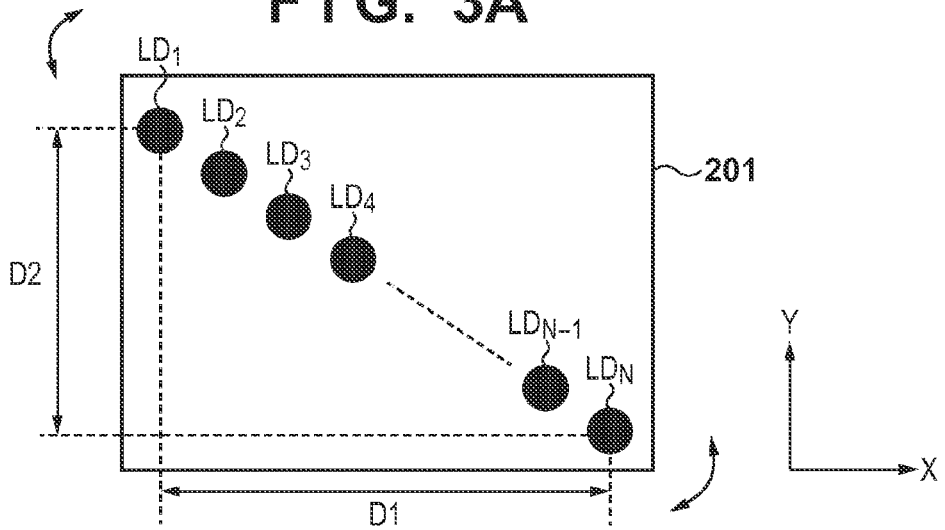
FIGS. 3A to 3C are diagrams showing an example of an overall configuration of a light source and an example of positions on a photosensitive drum and a BD sensor scanned by laser beams emitted from the light source.
Figure 3B:
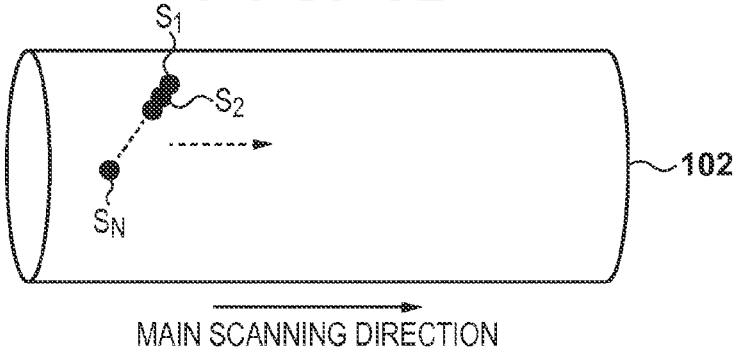

First, FIG. 3A is an enlarged view of the light source 201, and FIG. 3B is a diagram showing the scanning positions of the laser beams emitted from the light source 201 on the photosensitive drum 102. The light source 201 includes N light emitting elements ($LD_1$ to $LD_N$) that each emit (output) a laser beam. The n-th (n being an integer from 1 to N) light emitting element n ($LD_n$) of the light source 201 emits a laser beam $L_n$. The X axis direction in FIG. 3A is the direction that corresponds to the direction in which the laser beams deflected by the polygon mirror 204 scan the photosensitive drum 102 (the main scanning direction). Also, the Y axis direction is the direction orthogonal to the main scanning direction, and is the direction that corresponds to the rotation direction of the photosensitive drum 102 (sub-scanning direction).

As shown in FIG. 3B, the laser beams $L_1$ to $L_N$ that have been emitted from the light emitting elements 1 to N form spot-shaped images at positions $S_1$ to $S_N$ that are different in the sub-scanning direction on the photosensitive drum 102. According to this, the laser beams $L_1$ to $L_N$ scan main scanning lines that are adjacent in the sub-scanning direction in parallel on the photosensitive drum 102. Also, due to the light emitting elements 1 to N being arranged in an array as shown in FIG. 3A in the light source 201, the laser beams $L_1$ to $L_N$ form images at positions on the photosensitive drum 102 that are different in the main scanning direction as well, as shown in FIG. 3B. Note that in FIG. 3A, the N light emitting elements ($LD_1$ to $LD_N$) are arranged in one straight line (one-dimensionally) in the light source 201, but they may be arranged two-dimensionally.

Reference numeral D1 in FIG. 3A represents the interval (distance) between the light emitting element 1 ($LD_1$) and the light emitting element N ($LD_N$) in the X axis direction. In the embodiments, the light emitting elements 1 and N are light emitting elements arranged at the two ends of the light emitting elements that are arranged in a straight line in the light source 201. The light emitting element N is arranged the farthest from the light emitting element 1 in the X axis direction. For this reason, as shown in FIG. 3B, among the laser beams, the image forming position $S_N$ of the laser beam $L_N$ is at the position that is the farthest from the image forming position $S_1$ of the laser beam $L_1$ in the main scanning direction on the photosensitive drum 102.

Reference numeral D2 in FIG. 3A represents the interval (distance) between the light emitting element 1 ($LD_1$) and the light emitting element N ($LD_N$) in the Y axis direction. Among the light emitting elements, the light emitting element N is the farthest from the light emitting element 1 in the Y axis direction. For this reason, as shown in FIG. 3B, among the laser beams, the image forming position $S_N$ of the laser beam $L_N$ is at the position that is the farthest from the image forming position $S_1$ of the laser beam $L_1$ in the sub-scanning direction on the photosensitive drum 102.

A light emitting element interval Ps=D2/N−1 in the Y axis direction (sub-scanning direction) is an interval that corresponds to the resolution of the image that is to be formed by the image forming apparatus 100. Ps is a value that is set by performing rotation adjustment on the light source 201 in the assembly step of the image forming apparatus 100 (color multi-function printer) such that the interval between adjacent image forming positions $S_n$ in the sub-scanning direction on the photosensitive drum 102 becomes an interval that corresponds to a predetermined resolution. The light source 201 is subjected to rotation adjustment in the direction of the arrows in the plane including an X axis and a Y axis (XY plane), as shown in FIG. 3A. When the light source 201 is rotated, the interval between the light emitting elements in the Y axis direction changes, and the interval between the light emitting elements in the X axis direction changes as well. A light emitting element interval Pm=D1/N−1 in the X axis direction (main scanning direction) is a value that is determined uniquely depending on the light emitting element interval Ps in the Y axis direction.

The timings at which the laser beams are to be emitted from the light emitting elements ($LD_n$), and which are determined using the timing of the generation and output of the BD signals by the BD sensor 207 as a reference, are set using a predetermined jig for each light emitting element in the assembly step. The set times for the respective light emitting elements are stored in a memory 406 (FIG. 5) as initial values at the time of factory shipping of the image forming apparatus 100 (color multi-function printer). The initial values for the times at which the laser beams are to be emitted from the light emitting elements ($LD_n$) set in this way have values corresponding to Pm.

Figure 3C:
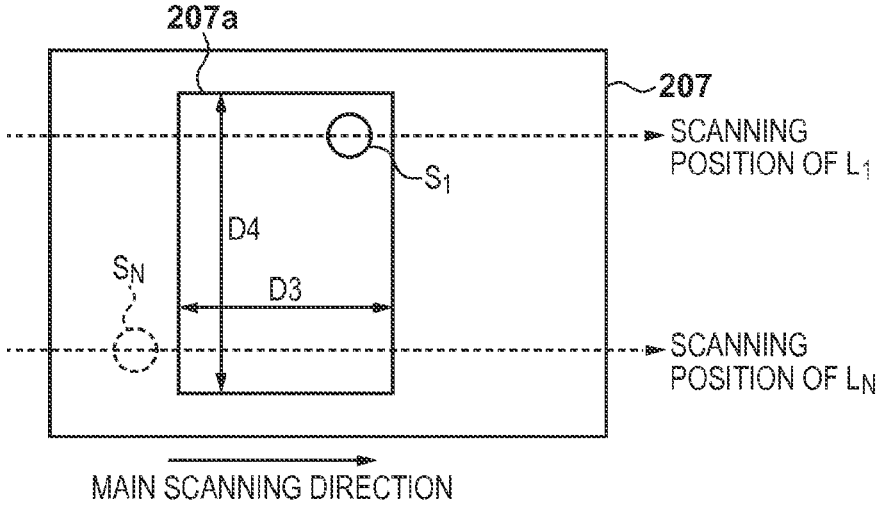

Next, FIG. 3C is a diagram showing a schematic configuration of the BD sensor 207 and the scanning positions of the laser beams emitted from the light source 201 on the BD sensor 207. The BD sensor 207 includes a light-receiving surface 207*a* on which photoelectric conversion elements are arranged planarly. When a laser beam is incident on the light-receiving surface 207*a*, the BD sensor 207 generates and outputs a BD signal indicating that a laser beam has been detected. In a later-described BD interval measurement, the optical scanning unit 104 causes the laser beams $L_1$ and $L_N$ that have been emitted from the light emitting elements 1 and N ($LD_1$ and $LD_N$) to be incident on the BD sensor 207 sequentially, thereby causing two BD signals corresponding to the respective laser beams to be emitted from the BD sensor 207 sequentially. Note that in the embodiments, the light emitting elements 1 and N ($LD_1$ and $LD_N$) are examples of a first light emitting element and a second light emitting element respectively.

In FIG. 3C, the width in the main scanning direction and the width in the direction corresponding to the sub-scanning direction of the light-receiving surface 207*a* are indicated as D3 and D4 respectively. In the embodiments, the laser beams $L_1$ and $L_N$ that are emitted from the light emitting elements 1 and N ($LD_1$ and $LD_N$) respectively scan the light-receiving surface 207*a* of the BD sensor 207 as shown in FIG. 3C. For this reason, the width D4 is set to a value that satisfies the condition D4>D2×α, such that both of the laser beams $L_1$ and $L_N$ can be incident on the light-receiving surface 207*a*. Note that a is the rate of fluctuation in the sub-scanning direction with respect to the interval between the laser beams $L_1$ and $L_N$ that have passed through the various lenses. Also, the width D3 is set to a value satisfying the condition $D3<D1\times\beta$ such that the laser beams $L_1$ and $L_N$ are not incident on the light-receiving surface 207*a* at the same time even when the light emitting elements 1 and N ($LD_1$ and $LD_N$) are illuminated at the same time. Note that β is the rate of fluctuation in the main scanning direction with respect to the interval between the laser beams $L_1$ and $L_N$ that have passed through the various lenses.

Control Configuration of Image Forming Apparatus

A control configuration of the image forming apparatus 100 will be described next with reference to FIG. 4. As shown in FIG. 4, as a control configuration related to image formation, the image forming apparatus 100 includes the central image processor 130, a reading system image processor 411, a PDL processor 412, an external I/F 413, an image memory 414, an external memory 415, and scanner unit controllers 210Y, 210M, 210C, and 210K.

The central image processor 130 temporarily stores, in the image memory 414, image data that has been subjected to PDL processing and the like by the PDL processor 412. The scanner unit controller 210 makes a request for image data to the central image processor 130 at a later-described time. After reading out image data from the image memory 414 in response to the request and performing image processing using the external memory 415 and the like, the central image processor 130 transmits the image data corresponding to each color to the scanner unit controller 210.

A BD signal generated and output by the BD sensor 207 is input to the scanner unit controller 210. The scanner unit controller 210 converts the image data received from the central image processor 130 into a laser driving pulse signal for controlling the light source 201. Furthermore, using the timing at which the BD signals was generated by the BD sensor 207 as a reference, the scanner unit controller 210 outputs the laser driving pulse signal to the laser driver 200.

Control Configuration of Optical Scanning Unit

Figure 5:
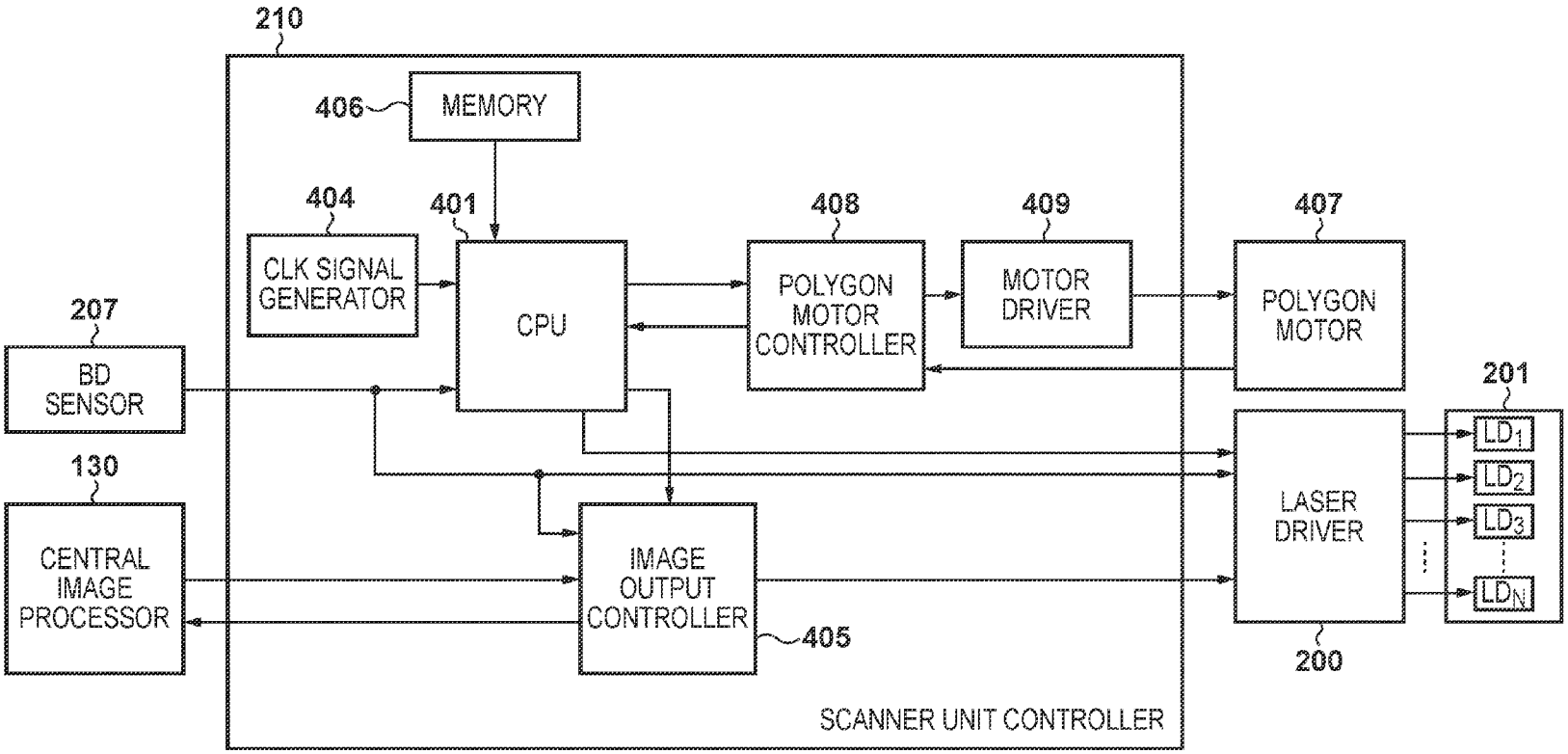
FIG. 5 is a block diagram showing an example of a configuration of a scanner unit controller.

The control configuration of the optical scanning unit 104 will be described next with reference to FIG. 5. FIG. 5 is a block diagram showing the configuration of the scanner unit controller 210. The scanner unit controller 210 includes a CPU 401, a clock (CLK) signal generator 404, an image output controller 405, a memory (storage unit) 406, a polygon motor controller 408, and a motor driver 409.

The CPU 401 performs overall control of the optical scanning unit 104 by executing a control program stored in the memory 406. The CLK signal generator 404 generates clock signals (CLK signals) at a predetermined frequency and outputs the generated CLK signals to the CPU 401. The CPU 401 counts the pulses of the CLK signal input from the CLK signal generator 404 and transmits a control signal to the polygon motor controller 408, the image output controller 405, and the laser driver 200 in synchronization with the CLK signal. The CPU 401 uses the control signal to control the polygon motor controller 408, the image output controller 405, and the laser driver 200.

The polygon motor controller 408 controls the rotation speed of the polygon mirror 204 by outputting an acceleration signal or a deceleration signal to the motor driver 409 in accordance with an instruction from the CPU 401. The polygon motor 407 is a motor that drives the polygon mirror 204 so as to rotate. The motor driver 409 causes the rotation of the polygon motor 407 to accelerate or decelerate in accordance with an acceleration signal or a deceleration signal output from the polygon motor controller 408.

The polygon motor 407 includes a speed sensor (not shown) that employs an FG (Frequency Generator) scheme for generating frequency signals that are proportional to the rotation speed of the polygon mirror 204. The polygon motor 407 uses the speed sensor to generate FG signals at a frequency corresponding to the rotation speed of the polygon mirror 204 and outputs the FG signals to the polygon motor controller 408. The polygon motor controller 408 measures the period for generating the FG signals input from the polygon motor 407, and when the measured period for generating the FG signals reaches a predetermined target period, the polygon motor controller 408 determines that the rotation speed of the polygon mirror 204 has reached the predetermined target rotation speed. Thus, the polygon motor controller 408 uses feedback control to control the rotation speed of the polygon mirror 204 according to the instruction from the CPU 401. Note that the CPU 401 can also determine the rotation speed of the polygon mirror 204 by receiving the FG signals output from the polygon motor 407 via the polygon motor controller 408.

BD signals generated and output by the BD sensor 207 are input to the CPU 401, the image output controller 405, and the laser driver 200. When the image output controller 405 receives input of a BD signal output from the BD sensor 207 at the time of image formation, the image output controller 405 makes a request to the central image processor 130 for each line of image data. The image output controller 405 converts each line of image data acquired from the central image processor 130 in response to the request into a laser driving pulse signal and outputs the laser driving pulse signal to the laser driver 200.

At the time of image formation, upon receiving input of a BD signal output from the BD sensor 207, the CPU 401 uses the BD signal as a reference to transmit a control signal for controlling the emission timings of the laser beams from the light emitting elements 1 to N to the image output controller 405. The emission timings of the laser beams from the light emitting elements 1 to N are controlled such that the writing start positions, in the main scanning direction, of the electrostatic latent images (images) for the light emitting elements 1 to N coincide. The image output controller 405 transfers the laser driving pulse signals corresponding to the image data for each line for the respective light emitting elements to the laser driver 200 at a timing based on the control signal.

A driving current based on the image data for image formation input from the image output controller 405 (i.e., a driving current modulated according to the image data) is supplied by the laser driver 200 to each of the light emitting elements ($LD_1$ to $LD_N$) at the time of image formation. According to this, the laser driver 200 causes a laser beam having a light power that corresponds to the driving current to be emitted from each of the light emitting elements.

Influence of Temperature Change on Optical Scanning Unit

Figure 6A:
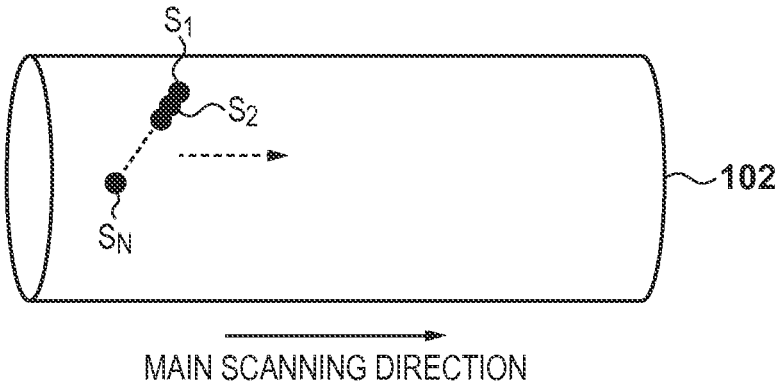
FIGS. 6A and 6B are diagrams showing an example of change in the positions on the photosensitive drum scanned by the laser beams emitted from the light source.

In the image forming apparatus 100, due to the configuration of the light sources 201 as shown in FIG. 3A, the laser beams emitted from the light emitting elements form images on the photosensitive drum 102 at positions $S_1$ to $S_N$ that are different in the main scanning direction as shown in FIG. 6A. In this kind of image forming apparatus, it is necessary to appropriately control the laser beam emission time for each light emitting element in order to align the writing start positions, in the main scanning direction, of the electrostatic latent images (images) that are formed by the laser beams emitted from the light emitting elements.

For example, a single BD signal is generated based on a laser beam emitted from a specific light emitting element, and the BD signal is used as a reference to control the light emitting elements such that the laser beams are emitted at fixed timings set in advance for respective light emitting elements. According to this control, it is possible to cause the writing start positions, in the main scanning direction, of the electrostatic latent images (images) formed by the laser beams emitted from the light emitting elements to coincide, as long as the relative positional relationship between the image forming positions $S_1$ to $S_N$ is always constant during image formation.

Figure 6B:
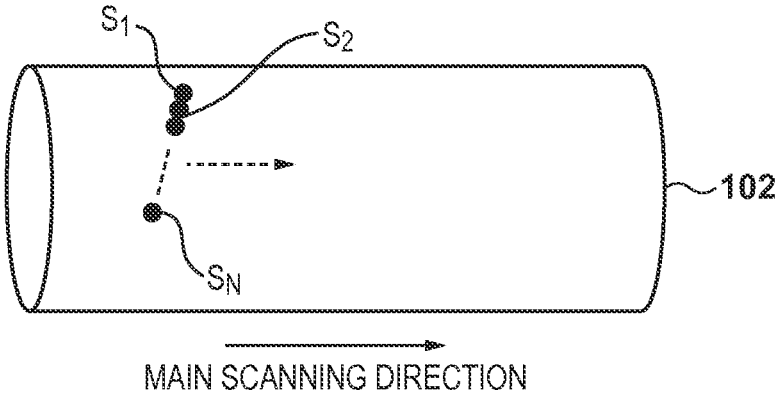

However, when the light emitting elements emit laser beams at the time of image formation, the wavelengths of the laser beams emitted from the light emitting elements change due to an increase in the temperatures of the light emitting elements. Also, due to the heat generated from the polygon motor 407 when rotating the polygon mirror 204, the temperature of the entire optical scanning unit 104 increases and the optical characteristics (refractive index, etc.) of the scanning lenses 205 and 206 and the like change. This causes the optical paths of the laser beams emitted from the light emitting elements to change. When this kind of change in the wavelength or optical path of the laser beams occurs, the image formation positions $S_1$ to $S_N$ of the laser beams change from the positions shown in FIG. 6A to the positions shown in FIG. 6B for example. When the relative positional relationship among the image forming positions $S_1$ to $S_N$ changes in this way, the writing start positions, in the main scanning direction, of the electrostatic latent images that are to be formed by the laser beams emitted from the light emitting elements cannot be caused to coincide by the laser emission timing control based on one BD signal described above.

In view of this, in the embodiments, two BD signals are generated by the BD sensor 207 using the laser beams emitted from two of the light emitting elements 1 to N (first and second light emitting elements), and the time interval between the two BD signals (also referred to as "BD interval" in the present specification) is measured. This interval measurement is performed in a non-image-forming period. When image formation is to be performed after the non-image-forming period, a single BD signal is used as a reference to control the relative laser beam emission timings based on the image data for the light emitting elements, according to the measurement value obtained by the BD interval measurement. For example, in the case of performing image formation on multiple recording sheets, the non-image-forming period in which BD interval measurement is performed is the period after an image is formed on a recording sheet and before image formation on a subsequent recording sheet is started. Accordingly, even if a temperature change occurs in a light emitting element or the like while image formation is being executed, the laser emission timings can be controlled such that the writing start positions, in the main scanning direction, of the electrostatic latent images formed by the laser beams emitted from the light emitting elements coincide.

BD Interval Measurement and Laser Emission Timing Control

Next, operations at the time of BD interval measurement and at the time of image formation in the optical scanning unit 104 according to the embodiments will be described with reference to FIGS. 7A, 7B, and 8.

At the time of BD interval measurement, the CPU 401 controls the light source 201 via the laser driver 200 such that two of the light emitting elements emit respective laser beams sequentially and the laser beams are sequentially incident on the BD sensor 207. That is to say, the BD interval measurement is performed based on two BD signals output sequentially from the BD sensor 207 (double BD mode). On the other hand, at the time of image formation, the CPU 401 controls the light source 201 via the laser driver 200 such that a laser beam emitted by a specific light emitting element is incident on the BD sensor 207. Furthermore, by using, as a reference, a single BD signal which is output from the BD sensor 207 in response to the laser beam being incident on the BD sensor 207, the CPU 401 controls the relative laser beam emission timings based on the image data for the respective light emitting elements (single BD mode).

Figure 7A:
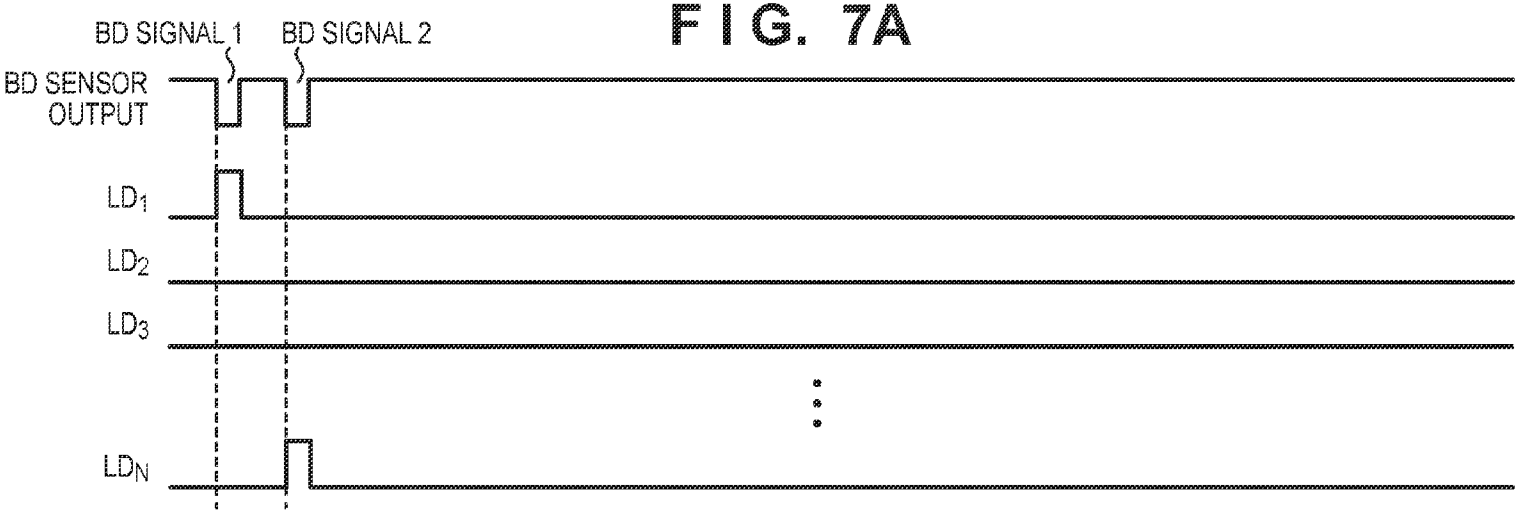
FIGS. 7A and 7B are timing charts indicating the timing of operations performed by light emitting elements in one scanning cycle of laser beams and the timing at which BD signals are generated by the BD sensor, at the time of BD interval measurement and at the time of image formation.
Figure 7B:
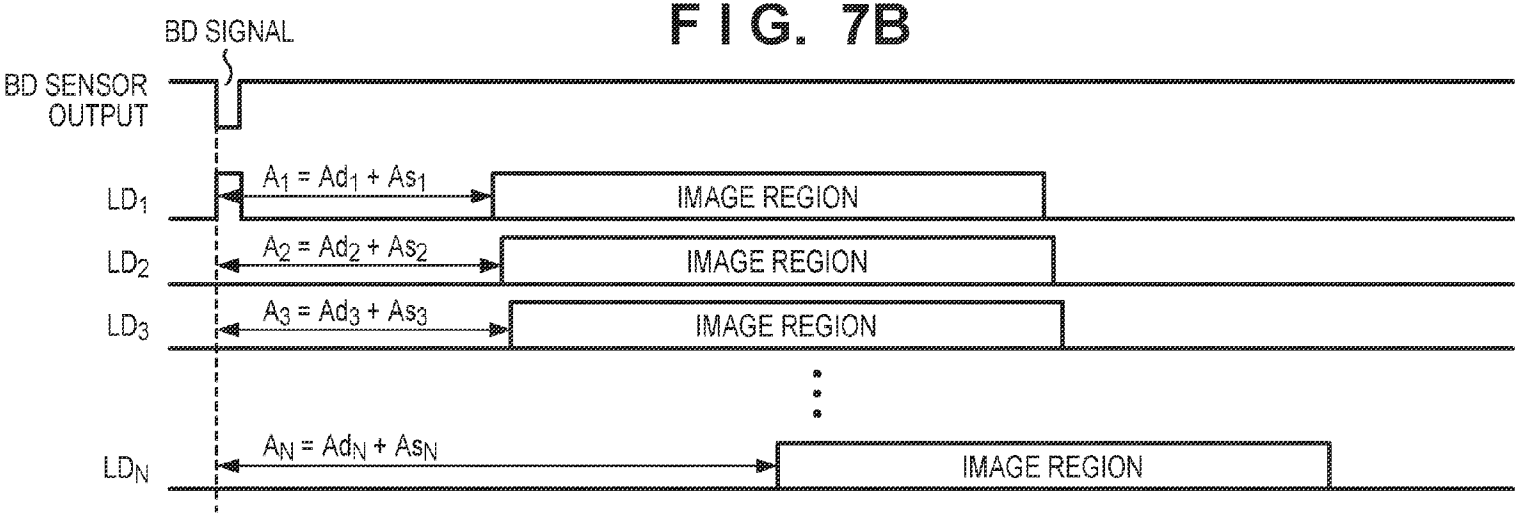
Figure 8:
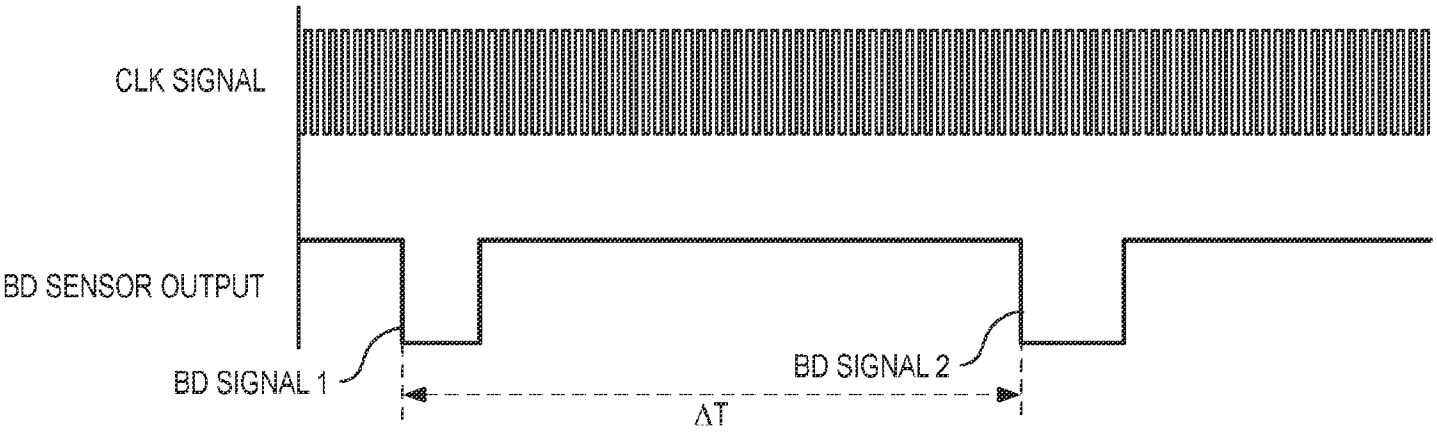
FIG. 8 is a diagram showing a relationship between BD interval measurement and a CLK signal.
Figure 9:
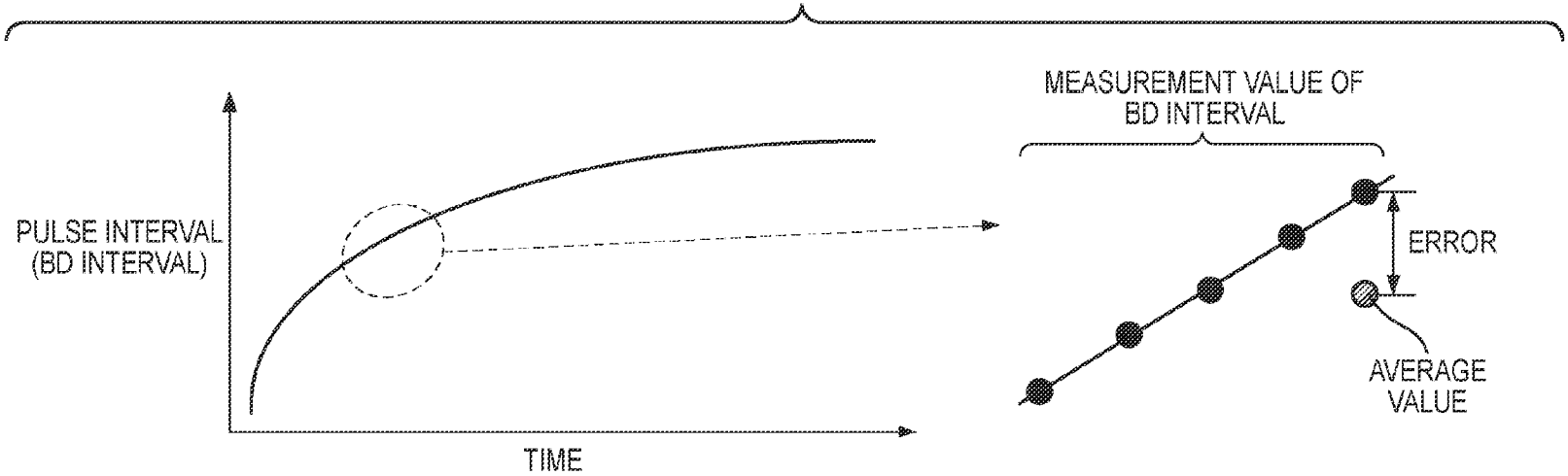
FIG. 9 is a diagram showing a relationship between measurement values and measurement error in BD interval measurement.

FIGS. 7A and 7B are timing charts showing the timing of operations performed by the light emitting elements and the timing of BD signal generation performed by the BD sensor in one laser beam scanning period, at the time of BD interval measurement and the time of image formation. Note that it is assumed hereinafter that the light emitting elements 1 and N are used to generate the two BD signals in the BD interval measurement, and the light emitting element 1 is used to generate the single BD signal at the time of image formation.

As shown in FIG. 7A, at the time of BD interval measurement executed in a non-image-forming period, drive signals are supplied from the laser driver 200 to the light emitting elements 1 and N respectively such that the laser beams emitted from the light emitting elements 1 and N ($LD_1$ and $LD_N$) are sequentially incident on the BD sensor 207. As a result, a BD signal generated by the BD sensor 207 due to reception of a laser beam from the light emitting element 1, and a BD signal generated by the BD sensor 207 due to reception of a laser beam from the light emitting element N are output from the BD sensor 207 (double BD mode). The CPU 401 performs measurement of the time interval between the times at which the two BD signals output sequentially from the BD sensor 207 are generated (BD interval measurement).

On the other hand, as shown in FIG. 7B, at the time of image formation, a drive signal is first supplied from the laser driver 200 to the light emitting element 1 such that the laser beam emitted from the light emitting element 1 ($LD_1$) is incident on the BD sensor 207. As a result, the single BD signal generated by the BD sensor 207 due to reception of the laser beam from the light emitting element 1 is output from the BD sensor 207 (single BD mode). Thereafter, when an image is to be formed on a recording sheet, the CPU 401 controls the laser emission timings of the light emitting elements 1 to N based on the single BD signal output from the BD sensor 207 and the emission start timing values $A_1$ to $A_N$ that are set with respect to the light emitting elements.

The emission start timing values $A_1$ to $A_N$ shown in FIG. 7B correspond to the light emission start times, of the light emitting elements 1 to N, that are based on the time at which the single BD signal was generated by the BD sensor 207. That is to say, $A_1$ to $A_N$ correspond to the relative delay times, for the respective light emitting elements 1 to N, of the emission times of the laser beams based on the image data, with respect to the single BD signal output from the BD sensor 207. $A_1$ to $A_N$ are set so as to coincide the writing start positions, in the main scanning direction, of the electrostatic latent images (images) formed by the laser beams emitted from the respective light emitting elements 1 to N.

$A_1$ to $A_N$ are obtained by using a correction value $As_n$ to correct the reference timing value $Ad_n$ for each of the light emitting elements, as shown in the following equation.

$$A_n = Ad_n + As_n (n=1,2,\ldots,N) \quad (1)$$

The CPU 401 controls the laser emission timing of the light emitting elements 1 to N by setting $A_1$ to $A_N$ in the image output controller 405. As shown in FIG. 7B, the image output controller 405 uses the generation time of the single BD signal as a reference to output the image data corresponding to each of the light emitting elements to the laser driver 200 at a timing in accordance with each of $A_1$ to $A_N$. According to this, at the timings in accordance with $A_1$ to $A_N$, the light emitting elements are driven by the laser driver 200, and each line of the electrostatic latent image (image) is formed at the desired main scanning position on the photosensitive drum 102.

The reference timing values $Ad_1$ to $Ad_N$ are values that are determined for the light emitting elements 1 to N at the time of factory adjustment under a specific temperature condition such that the electrostatic latent images are formed at the desired main scanning position, and the writing start positions of the electrostatic latent images in the main scanning direction coincide among multiple lines. $Ad_1$ to $Ad_N$ are stored in advance in the memory 406. Note that at the time of factory adjustment, the BD interval measurement is performed under the same temperature condition, and the count value, which is the result of the measurement, is stored in advance in the memory 406 as a reference count value Cr. Thus, the reference timing values $Ad_1$ to $Ad_N$ are set in advance in correspondence with the reference count value Cr.

Here, the count value corresponds to a value obtained by the CPU 401 counting the pulses of the CLK signal generated by the CLK signal generator 404. When BD interval measurement is to be performed, as shown in FIG. 8, the CPU 401 generates a count value by counting the pulses of the CLK signal in the period from when the BD signal 1 corresponding to the light emitting element 1 is generated until when the BD signal 2 corresponding to the light emitting element N is generated. The count value corresponds to a BD signal time interval AT and is generated as the measurement result of the BD interval measurement.

On the other hand, when the image forming positions $S_1$ to $S_N$ become misaligned due to a temperature change in light emitting elements or the like, it will no longer be possible to cause the writing start positions of the electrostatic latent image in the main scanning direction to coincide among multiple lines as described above. For this reason, the correction values $As_1$ to $As_N$ are generated by the CPU 401 using the following equation in order to compensate for this kind of misalignment in the image forming positions $S_1$ to $S_N$.

$$As_n=(Cs-Cr)/(N-1)\times k\times(n-1)(n=1,2,\ldots,N) \quad (2)$$

Here, n represents the number of a light emitting element. Cs is a count value that corresponds to the measurement results of the later-described BD interval measurements, and that is stored in the memory 406 (in steps S102 and S114). Cr is a reference value for BD interval measurement that is obtained using measurement at the time of factory adjustment. k is a conversion coefficient for converting the count value indicating the time interval between the two BD signals into the time interval for scanning in the image formation position on the photosensitive drum 102.

As can be understood from Equation (2), the correction value $As_1$ corresponding to the light emitting element 1 is always 0. For this reason, using the image forming position $S_1$ corresponding to the light emitting element 1 as a reference, Equation (2) generates correction values for correcting a misalignment among the image forming positions $S_1$ to $S_N$ due to a temperature change in light emitting elements or the like. As shown in Equation (1) and FIG. 7B, the CPU 401 can calculate the light emission start timing values $A_1$ to $A_N$ that are to be set with respect to the light emitting elements 1 to N, by respectively adding calculated $As_1$ to $As_N$, to $Ad_1$ to $Ad_N$, which are stored in the memory 406.

Averaging Processing for BD Interval Measurement Values

In order to perform BD interval measurement with greater accuracy, it is advantageous to perform averaging such as a moving average on multiple measurement results obtained using multiple times of BD interval measurement in a non-image-forming period. However, as described above, if the number of times of BD interval measurement executed in one non-image-forming period is not sufficient, there is a possibility that the number of measurement values needed to achieve the required measurement accuracy will not be obtained.

In view of this, the image forming apparatus 100 (e.g., the CPU 401) determines the time length (length of time) of the non-image-forming period in which an electrostatic latent image for forming a toner image to be transferred onto a recording medium is not formed, the time length being from when formation of an electrostatic latent image for forming a toner image to be transferred onto a recording medium ends, until when formation of an electrostatic latent image for forming a toner image to be transferred onto the next recording medium is started. When BD interval measurement is to be executed, the image forming apparatus 100 executes BD interval measurement a number of times that corresponds to the determined time length of the non-image-forming period, and calculates the average value of the resultant measurement values. In this way, by adaptively changing the number of times of executing BD interval measurement according to the time length of the non-image-forming period, it is possible to execute the largest number of times of BD interval measurement possible in the non-image-forming period. As a result, it is possible to execute laser emission timing control with greater accuracy.

The time length of the non-image-forming period (between sheets) changes depending on, for example, the type and size of the recording medium used in image formation. For this reason, the image forming apparatus 100 can determine the time length of the non-image-forming period based on the type and size of the recording medium to be used in image formation. Also, in the case where the image forming apparatus 100 is to execute an adjustment operation for adjusting an image forming condition in the non-image-forming period, the time length of the non-image-forming period changes depending on the time needed for the adjustment operation. For this reason, if an adjustment operation is to be executed in the non-image-forming period, the image forming apparatus 100 may determine the time length of the non-image-forming period based on the time needed for the adjustment operation.

Also, if the light power of the laser beams emitted by the two light emitting elements used in BD interval measurement is set such that the light power at the BD interval measurement time is different from the light power at the image formation time, the light power needs to be switched in the non-image-forming period. In such a case, the image forming apparatus 100 can calculate, as the measurement executable time for which measurement is possible, a time length obtained by subtracting, from the determined time length of the non-image-forming period, the switching time needed to switch the light power of the laser beams emitted from the two light emitting elements between the light power for measurement and the light power for image formation. Furthermore, based on the calculated executable time, the image forming apparatus 100 can decide the number of times of executing the BD interval measurement.

A specific example of processing executed by the image forming apparatus 100 will be described in greater detail below with reference to FIGS. 10, and 11A to 11C. Note that in the following example, it is assumed that the light source 201 includes 32 light emitting elements (i.e., N=32) and that the light emitting elements 1 and N (=32) are used in BD interval measurement, by way of example.

Here, when performing BD interval measurement, the image forming apparatus 100 repeats execution of the measurement a predetermined number of times, calculates the average value of the obtained measurement values, and uses the average value to perform laser emission timing control. The number of measurement values used in averaging (i.e., the number of times of BD interval measurement) may be determined such that the required measurement accuracy can be achieved. For example, the number of measurement values used in averaging can be determined as the number of times for controlling the emission timings, for the light emitting elements, of the laser beams based on image data with a pre-determined accuracy according to the average value. Note that in the present embodiment, measurement values obtained using 1000 times of BD interval measurement are used in averaging.

Figure 10A:
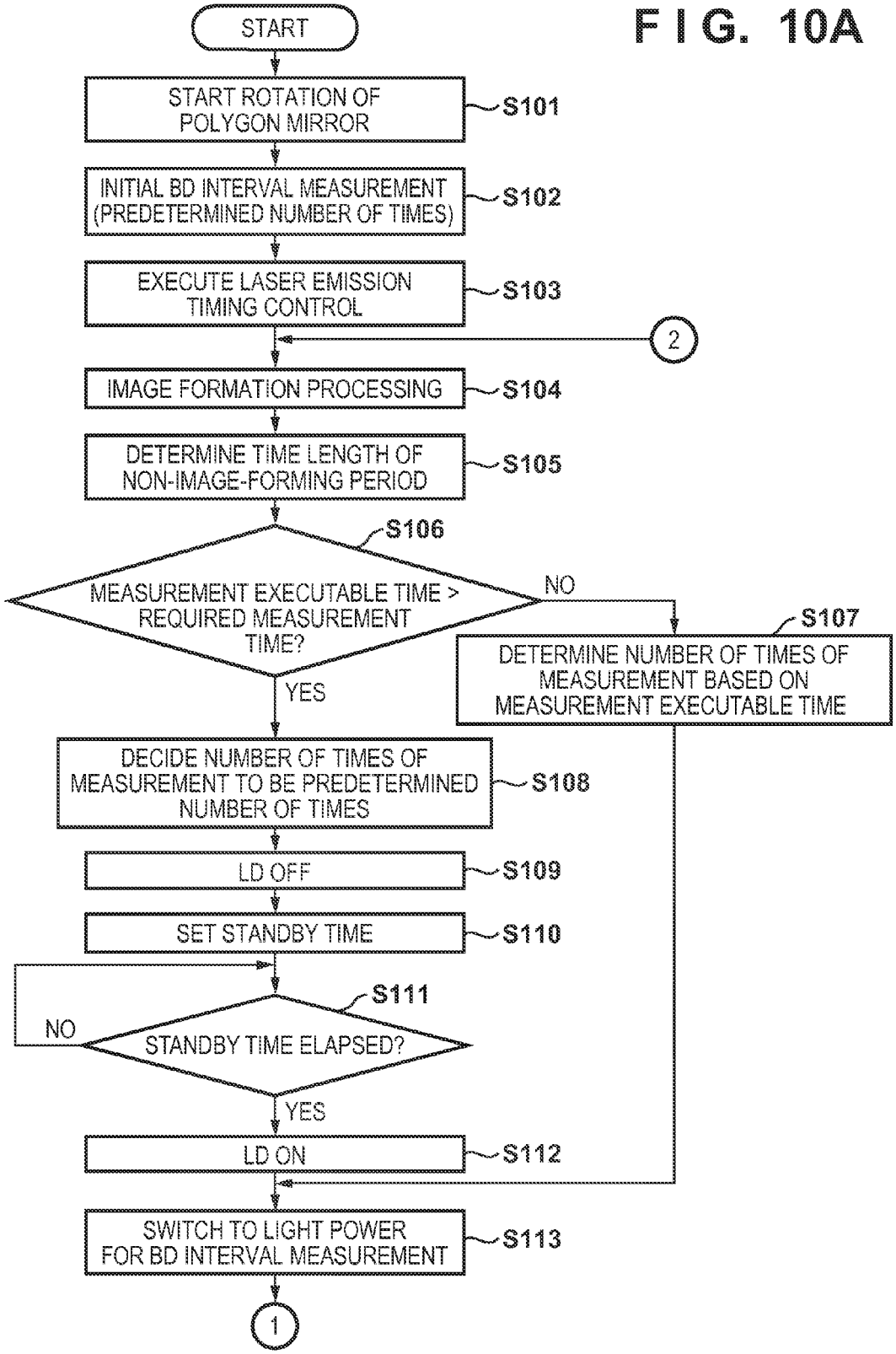
FIGS. 10A and 10B are flowcharts showing a procedure of image formation processing.
Figure 10B:
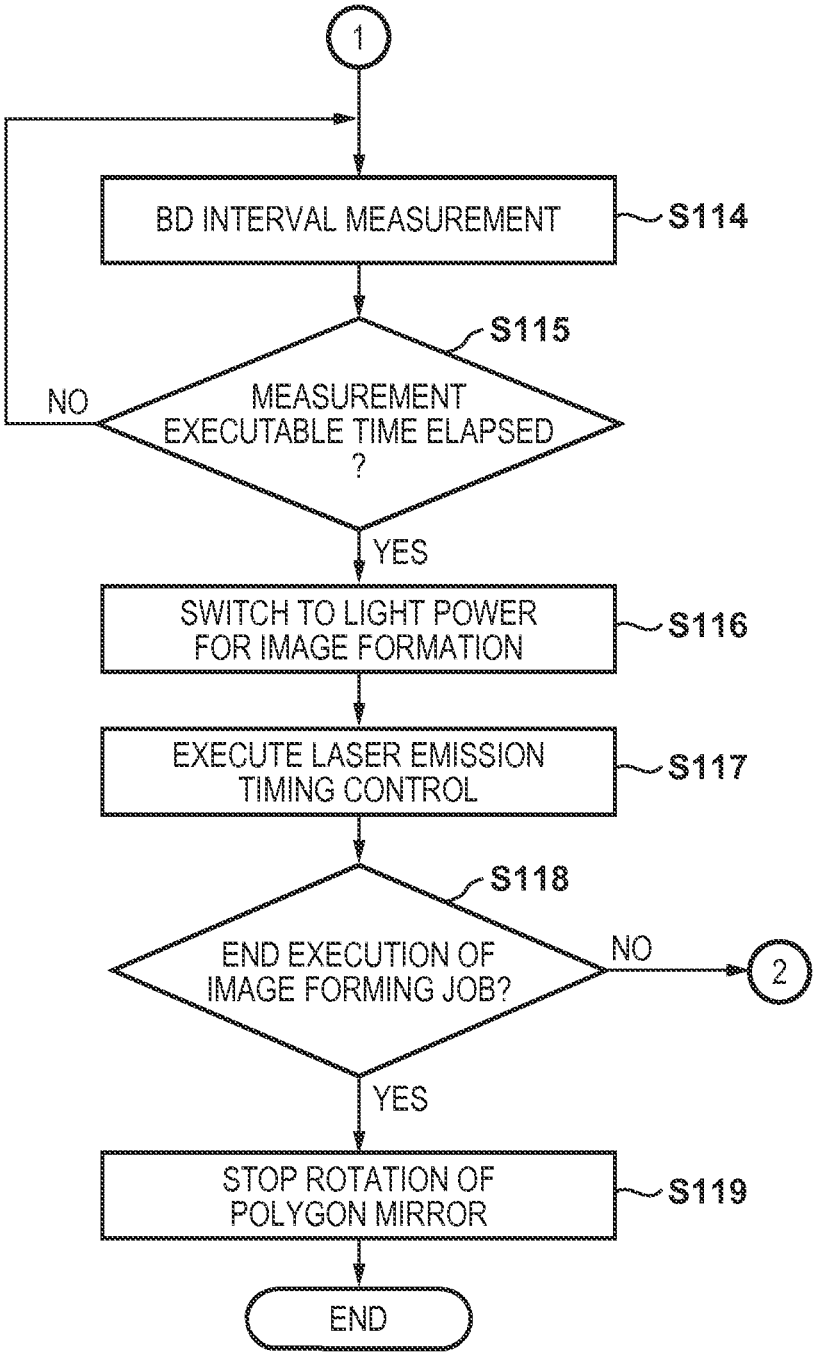

FIGS. 10A and 10B are flowcharts showing a procedure of image formation processing executed by the image forming apparatus 100. The processing of the steps shown in FIGS. 10A and 10B is realized by the CPU 401 reading out a control program stored in the memory 406 and executing it. When input of an image forming job for performing image formation on one or more recording sheets is received in the central image processor 130, the CPU 401 starts the processing of step S101.

In step S101, the CPU 401 transmits a control signal for starting the rotation of the polygon mirror 204 to the polygon motor controller 408. The polygon motor controller 408 drives the motor driver 409 according to the control signal from the CPU 401 so as to start the rotation of the polygon mirror 204. The polygon motor controller 408 controls the motor driver 409 based on an FG signal output from the polygon motor 407, such that the polygon mirror 204 rotates at a predetermined target rotation speed. When the rotation speed of the polygon mirror 204 reaches the target rotation speed, the CPU 401 advances the process to step S102.

In step S102, before starting image formation, the CPU 401 executes a predetermined number of times (1000 times) of initial BD interval measurement and calculates the average value of the 1000 measurement values that have been obtained. Specifically, the CPU 401 calculates the average value of 1000 count values Cs that correspond to the measurement results of BD interval measurement. Note that at the time of executing initial BD interval measurement, the CPU 401 sets the light power of the laser beams emitted by the light emitting elements 1 and 32 to a pre-determined light power for BD interval measurement.

Next, in step S103, the CPU 401 executes laser emission timing control based on the result of executing BD interval measurement (based on the average value). Specifically, based on the average value of the count values Cs obtained in step S102 and the reference count value Cr stored in advance in the memory 406, the CPU 401 uses Equation (2) to generate correction values $As_1$ to $As_{32}$ for correcting the writing start positions for the electrostatic latent images in the main scanning direction. By applying the generated correction values $As_1$ to $As_{32}$ to Equation (1), the CPU 401 determines the light emission start timing values $A_1$ to $A_{32}$ that are to be set for the light emitting elements 1 to 32 respectively and advances the process to step S104. That is to say, the CPU 401 controls the laser emission timings for the respective light emitting elements 1 to 32 using values obtained by correcting the light emission start timing values $A_1$ to $A_{32}$ according to the difference between the average value of Cs and the reference count value Cr (reference value), in accordance with Equation (2).

In step S104, the CPU 401 executes image formation on one recording sheet based on image data input from the central image processor 130 to the scanner unit controller 210. Note that the CPU 401 sets the light power of the laser beams emitted by the light emitting elements 1 and 32 to a predetermined light power for image formation and executes image formation. When image formation for one recording sheet ends, in step S105, the CPU 401 determines the time length of the non-image-forming period, which is from when image formation on one recording sheet ends to when image formation on the next recording sheet is started. Furthermore, the CPU 401 calculates, as the measurement executable time for which measurement is possible, a time length obtained by subtracting, from the time length of the non-image-forming period, the time for switching the light power of the laser beams emitted by the light emitting elements 1 and 32 (time for switching from the light power for image formation to the light power for measurement, and time for switching from the light power for measurement to the light power for image formation).

Figure 11A:
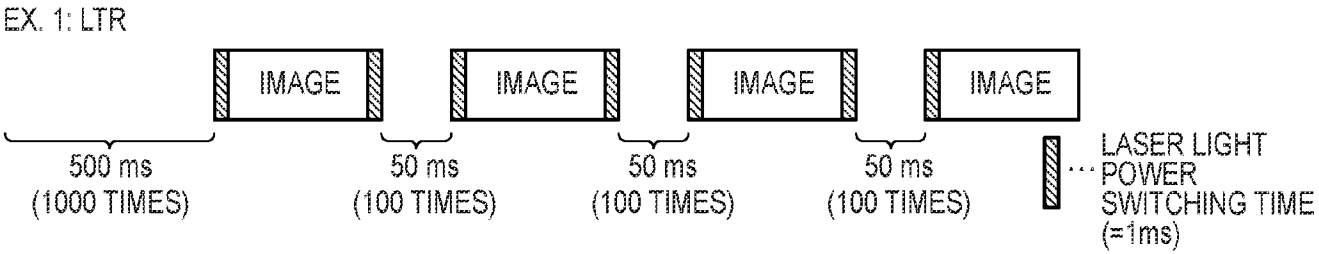
FIGS. 11A to 11C are diagrams that each show an example of, in a case of using a different type of recording sheet, a relationship between the time length of a non-image-forming period, and a measurement executable time for which measurement is possible and number of times of executing BD interval measurement, which are determined based on the time length.
Figure 11B:
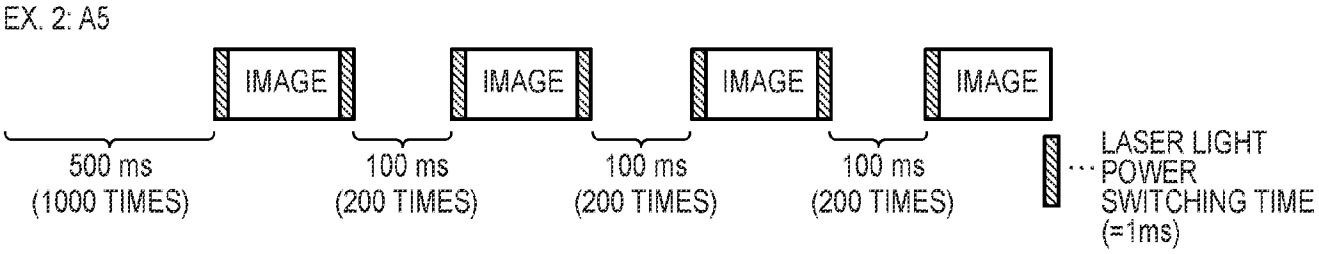
Figure 11C:
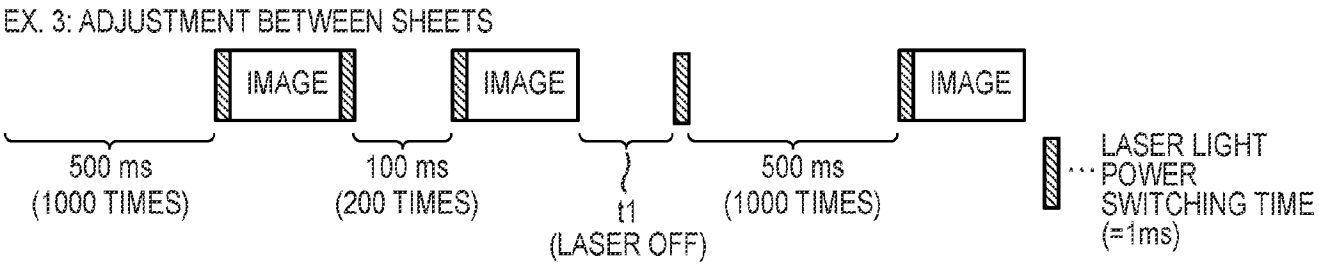

FIGS. 11A to 11C are diagrams that each show an example of, in a case of using a different type of recording sheet, a relationship between the time length of the non-image-forming period, and the measurement executable time and number of times of executing BD interval measurement, which are determined based on the time length. In these drawings, the time length obtained by subtracting, from the time length of a non-image-forming period in which image formation is not performed, the time for switching the light power of the laser beams emitted by the light emitting elements 1 and 32 is determined as the measurement executable time for which measurement is possible, and the number of times of executing measurement is decided based on the measurement executable time. FIGS. 11A and 11B show cases of using LTR-sized recording sheets and A5-sized recording sheets respectively in image formation, and show that the time length of the non-image-forming period (between sheets) is different according to the type (size) of the recording sheet. Also, FIG. 11C shows a case of using A5-sized recording sheets in image formation and executing an adjustment operation for adjusting an image forming condition in a non-image-forming period between image formation on a second recording sheet and image formation on a third recording sheet. Thus, if an adjustment operation is to be performed, the time length of the non-image-forming period increases in length in comparison to the case where no adjustment operation is to be performed.

Next, in step S106, the CPU 401 determines whether or not the measurement executable time is longer than the required measurement time. If it is determined that the measurement executable time is not longer than the required measurement time (measurement executable time≤required measurement time), the CPU 401 advances the process to step S107, and if the measurement executable time is longer than the required measurement time (measurement executable time>required measurement time), the CPU 401 advances the process to step S108.

(Case in which Measurement Executable Time≤Required Measurement Time)

In step S107, the CPU 401 decides the number of times of executing BD interval measurement based on the measurement executable time and advances the process to step S113. In step S113, the CPU 401 sets the light power of the laser beams emitted by the light emitting elements 1 and 32 to a pre-determined light power for BD interval measurement, and in step S114, the CPU 401 executes BD interval measurement. Each time BD interval measurement is executed, in step S115, the CPU 401 determines whether or not the measurement executable time has elapsed, and as long as it is determined that it has not elapsed, the CPU 401 repeats BD interval measurement in step S114. On the other hand, upon determining in step S115 that the measurement executable time has elapsed, the CPU 401 advances the process to step S116. In this way, the CPU 401 executes the number of times of BD interval measurement that can be executed in the measurement executable time (i.e., the number of times decided in step S107), and calculates an average value by using the resultant measurement values.

For example, as in the example shown in FIG. 11A, if the measurement executable time, which is obtained by subtracting the light power switching time from the non-image-forming period, is 50 ms and 500 μs are required for executing BD interval measurement once, 100 times of BD interval measurement can be performed in one non-image-forming period (in the measurement executable time). In this case, in order to perform a predetermined number of times (1000 times) of BD interval measurement, 10 non-image-forming periods (measurement executable times) are needed. On the other hand, if the measurement executable time, which is obtained by subtracting the light power switching time from the non-image-forming period, is 100 ms as in the example shown in FIG. 11B, 200 times of BD interval measurement can be performed in one non-image-forming period (in the measurement executable time). In this case, in order to perform the predetermined number of times (1000 times) of BD interval measurement, five non-image-forming periods (times for which measurement is possible) will be sufficient.

Accordingly, if the measurement executable time is not longer than the required measurement time, in step S115, the CPU 401 may calculate the average value of the measurement values obtained in the most recent predetermined number of times (1000 times) of measurement in one non-image-forming period and past non-image-forming periods. Note that if multiple image forming jobs are executed with some degree of time interval therebetween, the average value may be calculated by using measurement values obtained in the most recent predetermined number of times (1000 times) of measurement in multiple non-image-forming periods during the execution of one image forming job. This is because if the measurement values are averaged over multiple image forming jobs, there is a possibility that the measurement accuracy will decrease due to temperature change in the optical scanning apparatus at the start of an image forming job. Note that as will be described below, if the measurement executable time is longer than the required measurement time, the CPU 401 calculates the average value of the measurement values obtained using a predetermined number of times (1000 times) of measurement in one non-image-forming period.

In this way, by adaptively changing the number of times of executing BD interval measurement according to the time length of the non-image-forming period, it is possible to execute the largest number of times of BD interval measurement possible in the non-image-forming period. This makes it possible to reduce, to the greatest extent possible, the time needed for executing a predetermined number of times of BD interval measurement according to which measurement values needed for averaging are obtained. As a result, it is possible to improve the accuracy of BD interval measurement while following temperature change in the optical scanning apparatus.

Subsequently, in step S116, the CPU 401 sets the light power of the laser beams emitted by the light emitting elements 1 and 32 to a pre-determined light power for image formation in preparation for image formation on the next recording sheet, and the CPU 401 advances the process to step S117. In step S117, similarly to step S103, the CPU 401 executes laser emission timing control based on the result of executing BD interval measurement (based on the average value), and the CPU 401 advances the process to step S118. In step S118, the CPU 401 determines whether or not to end execution of the image forming job. If image formation on the number of recording sheets set for the image forming job has ended, the CPU 401 determines that execution of the image forming job is to be ended, and in step S119, the CPU 401 stops the rotation of the polygon mirror and ends the process. On the other hand, if image formation on the number of recording sheets set for the image forming job has not ended, the CPU 401 determines that execution of the image forming job is not to be ended, returns the process to step S1004, and executes image formation processing on the next recording sheet.

(Case in which Measurement Executable Time>Required Measurement Time)

If the measurement executable time is longer than the required measurement time, a predetermined number of times (1000 times) of BD interval measurement can be performed in a non-image-forming period. For this reason, in step S108, the CPU 401 sets the number of times of executing BD interval measurement to the predetermined number of times (1000 times) and advances the process to step S109.

If the measurement executable time is longer than the required measurement time, BD interval measurement does not need to be constantly executed in the non-image-forming period. For this reason, in step S109, the CPU 401 temporarily turns off (switches to a turned-off state) all of the light emitting elements (LDs). Thereafter, in step S110, the CPU 401 sets a time obtained by subtracting the light power switching time and the required measurement time from the time length of the non-image-forming period as standby time (=time length of non-image-forming period−light power switching time−required measurement time).

Furthermore, by determining in step S111 whether or not the set standby time has elapsed, the CPU 401 keeps all of the light emitting elements in the turned-off state until the standby time elapses. Upon determining in step S111 that the standby time has elapsed, the CPU 401 advances the process to step S112 and once again turns on the light emitting elements 1 and 32 used in BD interval measurement (switches to a turned-on state). Thereafter, the CPU 401 advances the process to step S113. Thus, by setting the time for which the predetermined number of times of BD interval measurement are not executed as the standby time and switching the light emitting elements to the turned-off state in the non-image-forming period, it is possible to reduce the time for which the light emitting elements are kept in the turned-on state to the greatest extent possible, and to reduce consumption of the light emitting elements. As a result, it is possible to increase the lifespan of the light emitting elements.

For example, if the image forming apparatus 100 performs an adjustment operation in the non-image-forming period, as in the example shown in FIG. 11C, the measurement executable time can become longer than the required measurement time. In this case, a time t1 obtained by subtracting, from the non-image-forming period, the light power switching time and the required measurement time for a predetermined number of times (1000 times) of BD interval measurement (500 ms) is set as the standby time in which BD interval measurement is not performed. By switching the light emitting elements 1 and 32 to the turned-off state during the time t1, it is possible to reduce consumption of these light emitting elements. Also, in the present example, BD interval measurement is started in the non-image-forming period such that the predetermined number of times (1000 times) of BD interval measurement are completed immediately before the light power of the laser beams emitted from the light emitting elements 1 and 32 for image formation on the next recording sheet is switched from the light power for measurement to the light power for image formation, for preparing for image formation on the next recording sheet. Thus, the length of the time from when BD interval measurement is performed to when the measurement result is applied to the laser emission timing control is reduced to the greatest extent possible, and thereby the laser emission timing control can be performed with greater accuracy.

The processing of steps S113 to S119 is similar to that in the case where the measurement executable time is not longer than the required measurement time. Note that in steps S114 and S115, the CPU 401 can calculate the average value of the measurement values obtained using the predetermined number of times (1000 times) of measurement in one non-image-forming period.

As described above, according to the above-described embodiment, the time length of the non-image-forming period is determined, and the number of times of executing BD interval measurement is changed adaptively in accordance with the determined time length. Accordingly, it is possible to execute the greatest number of times of BD interval measurement possible in the non-image-forming period, and laser emission timing control can be executed with greater accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-077254, filed Apr. 3, 2014, which is hereby incorporated by reference herein in its entirety.

What is claimed is:

1. An image forming apparatus including a light source that includes a plurality of light emitting elements that each emit a light beam, and a deflection unit configured to deflect a plurality of light beams emitted from the plurality of light emitting elements such that the plurality of light beams scan a photosensitive member, the image forming apparatus being configured to: use toner to develop an electrostatic latent image formed on the photosensitive member by scanning the photosensitive member with the plurality of light beams; to transfer a developed toner image onto a recording medium; and to fix the transferred toner image to the recording medium by heating the transferred toner image, the image forming apparatus being further configured to change, depending on a type of a recording medium onto which a toner image is to be transferred, a length of a non-image-forming period, wherein the non-image-forming period is a period from when formation of an electrostatic latent image for forming a toner image to be transferred onto one recording medium ends to when formation of an electrostatic latent image for forming a toner image to be transferred onto a next recording medium starts, the image forming apparatus comprising:

an optical sensor provided on a scanning path of a light beam deflected by the deflection unit, configured to, in response to the deflected light beam being incident on the optical sensor, output a detection signal indicating that the light beam has been detected;

a measurement unit configured to, in the non-image-forming period, control the light source such that light beams from first and second light emitting elements among the plurality of light emitting elements are incident on the optical sensor in sequence, and further configured to measure a time interval between two detection signals output in sequence from the optical sensor;

a determination unit configured to determine a number of times of measurement of the time interval to be executed by the measurement unit in the non-image-forming period, based on a type of a recording medium onto which a toner image is to be transferred; and a control unit configured to, based on an average value of measurement values obtained by the measurement unit, control relative emission timings according to which the plurality of light emitting elements emit light beams based on image data, when image formation on a recording medium is to be performed.

2. The image forming apparatus according to claim 1, wherein the determination unit determines the number of times of the measurement of the time interval to be executed in the non-image-forming period based on a type or a size of a recording medium onto which a toner image is to be transferred.

3. The image forming apparatus according to claim 1, further comprising:

a storage unit configured to store in advance a reference value that is to be used as a reference for control performed by the control unit, and timing values indicating emission timings according to which the plurality of light emitting elements emit the light beams and which are determined in correspondence with the reference value, wherein the control unit controls the relative emission timings for the plurality of light emitting elements by using values obtained by correcting the timing values according to a difference between the average value and the reference value.

4. The image forming apparatus according to claim 3, wherein the control unit controls, according to the average value, relative delay times of the relative emission timings based on image data, with respect to one detection signal output from the optical sensor.

5. The image forming apparatus according to claim 1, further comprising:

the plurality of light emitting elements are arranged linearly in a line in the light source, and the first and second light emitting elements are light emitting elements arranged on both ends of the plurality of light emitting elements.

6. The image forming apparatus according to claim 1, further comprising:

the photosensitive member;

a charging unit configured to charge the photosensitive member; and a developing unit configured to form develop an electrostatic latent image formed on the photosensitive member by the scanning of the plurality of light beams so as to form, on the photosensitive member, a toner image to be transferred onto a recording medium.

* * * * *